US012305550B2

(12) United States Patent
Zhang et al.

(10) Patent No.: US 12,305,550 B2
(45) **Date of Patent: *May 20, 2025**

(54) COVER ASSEMBLY, PIPE ASSEMBLY AND TURBINE FRACTURING UNIT

(71) Applicant: YANTAI JEREH PETROLEUM EQUIPMENT & TECHNOLOGIES CO., LTD., Shandong (CN)

(72) Inventors: Peng Zhang, Shandong (CN); Rikui Zhang, Shandong (CN); Shanwu Fu, Shandong (CN); Weipeng Yuan, Shandong (CN); Jianwei Wang, Shandong (CN); Zhuqing Mao, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 321 days.

This patent is subject to a terminal disclaimer.

(21) Appl. No.: 17/900,348

(22) Filed: Aug. 31, 2022

(65) Prior Publication Data

US 2022/0412200 A1 Dec. 29, 2022

Related U.S. Application Data

(63) Continuation of application No. PCT/CN2021/074180, filed on Jan. 28, 2021.

(30) Foreign Application Priority Data

Dec. 2, 2020 (CN) ..... 202022891295.X

(51) Int. Cl.
*F01N 13/08* (2010.01)
*E21B 43/26* (2006.01)
(Continued)

(52) U.S. Cl.
CPC ..... *F01N 13/085* (2013.01); *E21B 43/2607* (2020.05); *F01N 13/002* (2013.01); *F01N 2390/08* (2013.01); *F01N 2590/10* (2013.01)

(58) Field of Classification Search
CPC ..... F01N 13/085; F01N 13/08; F01N 13/002; F01N 2390/08; F01N 2590/10;
(Continued)

(56) References Cited

U.S. PATENT DOCUMENTS 2,350,102 A 5/1944 Fairbanks
3,446,010 A 5/1969 Hopkins
(Continued)

FOREIGN PATENT DOCUMENTS

CN 106122669 A 11/2016
CN 206429802 U 8/2017
CN 210462142 U 5/2020

OTHER PUBLICATIONS

International Search Report mailed Aug. 4, 2021 for International Application No. PCT/CN2021/074180, including English translation.

(Continued)

*Primary Examiner* — Edgardo San Martin
(74) *Attorney, Agent, or Firm* — Crowell & Moring

(57) ABSTRACT

The present disclosure provides a rain cover assembly, a pipe assembly and a turbine fracturing unit. The rain cover assembly comprises at least two sets of cover plate assemblies, wherein each set of cover plate assembly comprises a cover plate, a transmission mechanism and a locking device. When the cover plate(s) is(are) at a closed position, the opening is covered; when the cover plate of each set of cover plate assembly is at an open position, an additional pipe structure which is open at both ends and extends along an extension direction of the pipe is formed by which. Accord-
(Continued)

ing to the present disclosure, the cover plate(s) of the rain cover assembly, when opened, will jointly form an additional pipe structure connected to the open end of the pipe to guide the exhaust gas of the pipe to a further space. Such an arrangement may reduce noise on the one hand, and prevent backflow of the exhaust gas on the other hand. The cover plate(s) of the rain cover assembly, when closed, can shield the opening of the pipe to prevent entry of rainwater.

17 Claims, 14 Drawing Sheets

(51) Int. Cl.
*F01D 25/30* (2006.01)
*F02C 7/24* (2006.01)
*F01N 13/00* (2010.01)

(58) Field of Classification Search
CPC . E21B 43/2607; F16L 55/115; F16L 55/1155; F16L 55/1157; F02C 7/24; B64D 33/06; B64D 33/04; B64F 1/26; F01D 25/30
See application file for complete search history.

(56) References Cited

U.S. PATENT DOCUMENTS

| | | | | |
|---|---|---|---|---|
| 3,960,063 | A | 6/1976 | Siemes | |
| 4,106,290 | A | 8/1978 | Johnson | |
| 5,213,157 | A | 5/1993 | Wills | |
| 5,428,957 | A | 7/1995 | Keats | |
| 5,876,282 | A | 3/1999 | Kenny | |
| 6,457,550 | B1 | 10/2002 | Barry | |
| 8,534,235 | B2 | 9/2013 | Chandler | |
| 8,960,564 | B2 | 2/2015 | Chandler | |
| 10,954,855 | B1 | 3/2021 | Ji | |
| 10,961,914 | B1 | 3/2021 | Yeung | |
| 10,961,993 | B1 | 3/2021 | Ji | |
| 11,105,250 | B1 * | 8/2021 | Zhang | E21B 43/2607 |
| 11,242,802 | B2 | 2/2022 | Yeung et al. | |
| 11,459,954 | B2 * | 10/2022 | Yeung | F01D 25/30 |
| 2008/0282690 | A1 | 11/2008 | Ikeda | |
| 2010/0200792 | A1 | 8/2010 | Ikeda | |
| 2014/0048268 | A1 | 2/2014 | Chandler | |
| 2023/0374916 | A1 * | 11/2023 | Ji | F01D 25/30 |
| 2024/0167396 | A1 * | 5/2024 | Rodriguez-Ramon | E21B 43/2607 |

OTHER PUBLICATIONS

Written Opinion mailed Aug. 4, 2021 for International Application No. PCT/CN2021/074180.

Office Action issued in related U.S. Appl. No. 18/347,346 dated Sep. 16, 2024, 8 pages.

* cited by examiner

COVER ASSEMBLY, PIPE ASSEMBLY AND TURBINE FRACTURING UNIT

CROSS REFERENCES

This application is a continuation of and claims the benefit of priority to PCT Application No. PCT/CN2021/074180, filed on Jan. 28, 2021, which is based on and claims the benefit of priority to Chinese Patent Application No. 202022891295.X, filed on Dec. 2, 2020. These prior patent applications are hereby incorporated by reference in their entireties.

FIELD

The present disclosure relates to a rain cover assembly and a pipe assembly having the same. The present disclosure further relates to a turbine fracturing unit, wherein the rain cover assembly is mounted on an exhaust port of the turbine fracturing unit.

BACKGROUND

At present global oil and gas field fracturing operation sites, exhaust mufflers are usually mounted on turbine engines. An exhaust muffler mainly functions to allow the exhaust gas of the turbine engine to be guided out, and in the meanwhile reduce noise and prevent the exhaust gas from returning back to the turbine engine. The conventional exhaust mufflers and openings of other types of pipes are usually mounted with rain covers. A rain cover is fixed on the exhaust muffler via bolts. In an unoperated state, the rain cover is in a closed state and thereby prevents rainwater from entering the exhaust muffler. The rain cover on the conventional exhaust muffler is in a form of a single cover plate, and is usually controlled to open or close driven by an electrical winch.

The arrangement of conventional rain cover might cause the following problems with the exhaust muffler:

1. Insufficient safety factor: in an unoperated state, the conventional single-cover plate exhaust muffler cannot properly shield/cover the opening of the exhaust muffler. There is still a risk that rainwater, dusts and debris may enter the turbine engine. Debris might still deposit in the interior of the exhaust muffler, which affects the water-draining function.

2. High noise: due to limitations from road regulations, the height of the conventional exhaust muffler might not be enough, so the exhaust gas after passing through the exhaust muffler is noisy;

3. Unreasonable structure: as the height of the exhaust muffler might not be enough, the exhaust gas cannot be led to an high enough level, so the exhaust gas might be sucked back by the turbine engine intake system again, which reduces the lifetime of the turbine engine.

Therefore, it is desirable to provide a rain cover assembly, a pipe assembly and a turbine fracturing unit to at least partially solve the above-mentioned problems. The rain cover assembly provided by the present disclosure is not limited to the use for the above-mentioned turbine fracturing unit, but may be applied to a variety of pipes with openings. The pipe assembly provided by the present invention may also be applied to a variety of power machines/equipment.

SUMMARY

An object of the present disclosure is to provide a rain cover assembly. Cover plates of the rain cover assembly according to the present disclosure, when opened, jointly form an additional pipe structure connected to an open end of the pipe to guide the exhaust gas of the pipe to a further space. Such an arrangement may reduce noise on the one hand, and prevent backflow of the exhaust gas on the other hand. The cover plates of the rain cover assembly, when closed, can shield the opening of the pipe to prevent entry of rainwater.

According to an aspect of the present disclosure, there is provided a rain cover assembly for mounted on an opening of a pipe, wherein the rain cover assembly comprises at least one set of cover plate assembly, where each set of cover plate assembly comprises:

- a cover plate mounted on the opening of the pipe and being movable relative to the pipe between a closed position where the cover plate covers the opening and an open position where the cover plate exposes the opening;
- a transmission mechanism whose one end is fixed with the cover plate;
- a locking device which is directly or indirectly connected to the other end of the transmission mechanism, and configured to lock the transmission mechanism to maintain the cover plate at the open position,
- wherein the at least one set of cover plate assembly is configured such that when at least part of the cover plate(s) is(are) at the closed position, the opening is covered by the at least part; when the cover plate of each set of cover plate assembly is at the open position, an additional pipe structure that opens at both ends and extends along an extension direction of the pipe is formed by the cover plate(s).

In one embodiment, the rain cover assembly comprises at least two sets of cover plate assemblies, and the pipe opens upward, and the cover plate of each of the cover plate assemblies is mounted on an edge of the pipe and capable of pivoting about a pivot axis perpendicular to a centerline of the pipe. According to this solution, the rain cover assembly according to the present disclosure is particularly adapted for pipes with upward openings to prevent rainwater or sundries from falling into the pipes due to gravity.

In one embodiment, there are two cover plate assemblies, the two cover plate assemblies are disposed about the open end opposite to each other, and at least one of cover plate(s) comprises(comprise) an intermediate plate and two side plates respectively connected to two opposite ends of the intermediate plate, and the intermediate plate is perpendicular to the side plates; when the two cover plates are at the open position, the intermediate plate(s) and the side plates all extend in a vertical direction; when the two cover plates are at the closed position, the intermediate plate(s) covers (cover) the open end and the side plates are located outside the pipe. In one embodiment, the cover plates of the two cover plate assemblies are arranged completely symmetrically about the opening of the pipe.

According to the above two solutions, a specific structural example of cover plates that can form additional pipe is given, and in this example, at least one of the two cover plates can abut against the outer side wall of the pipe in the open state, thereby saving the space and prevent the cover from being damaged by collision.

In one embodiment, when the cover plates of each cover plate assembly are at the closed position, the cover plates at least partially overlap. According to this solution, the overlap of the cover plates can enhance the effect of covering the opening of the pipe.

In an embodiment, each of the cover plate assemblies further comprises a connecting member connecting the cover plate with the pipe, and the connecting member comprises:

a base being an integral fixed member and fixed on the outside of the pipe;

a pivoting portion fixed on the cover plate and pivotally connected with the base.

In one embodiment, the base comprises a base plate and an ear, a portion of the base plate is parallel to a pivot axis of the cover plate and abuts an outer side wall of the pipe, and the ear forms a pivot mounting hole, and the pivoting portion is a plate-shaped structure and is pivotally connected to the pivot mounting hole of the ear.

According to the above two solutions, the pivoting portion is formed as a driven member of the cover plate, and the arrangement of the base and the pivoting portion can facilitate the proper connection between the cover plate and the pipe, and not only ensures the connection strength of the two but also satisfies the flexibility of the cover plate moving relative to the pipe.

In one embodiment, the base comprises a limiting portion, and the limiting portion is configured in a way that the limiting portion abuts against the cover plate when the cover plate pivots to the open position, to limit further pivoting of the cover plate.

According to this solution, the setting of the limiting portion can limit the excessive movement of the cover plate relative to the pipe, thereby ensuring the connection strength between the cover plate and the pipe, and can prevent the cover plate from being disconnected from the pipe due to excessive movement.

In an embodiment, each set of the cover plate assemblies further comprises a power mechanism, and the power mechanism is directly connected to the other end of the transmission mechanism to drive the transmission mechanism so that the transmission mechanism drives the cover plate to move.

In an embodiment, a forced ear is fixedly disposed on the cover plate, and the transmission mechanism engages with the forced ear.

According to the above two solutions, the provision of the power mechanism enables the rain cover assembly to be used for large pipes, and the power mechanism can automatically open and close larger and heavier cover plates, making the rain cover assembly more automated.

In an embodiment, the transmission mechanism comprises a transmission rod, the transmission rod comprises two first rod portions and a second rod portion located between the two first rod portions, both ends of the second rod portion are respectively sleeved in corresponding first rod portions, and the transmission rod is configured in a way that the two first rod portions can move away from or close to each other to adjust a total length of the transmission rod. According to this solution, setting the transmission rod adjustable in height can facilitate more efficient and flexible control of the movement of the cover plate.

In an embodiment, the power mechanism comprises an electric power mechanism or a pneumatic power mechanism.

According to the above several solutions, some specific examples of power mechanism and transmission mechanism are provided. According to these specific examples, the power mechanism and transmission mechanism can effectively and flexibly control the pivoting of the cover plate relative to the pipe.

In an embodiment, the rain cover assembly further comprises a baffle fixed relative to the pipe and extending along a connection gap between the pipe and the cover plate to shield the gap. According to this solution, the baffle can further block entry of rainwater into the pipe.

In an embodiment, the power mechanism comprises a hydraulic cylinder, a hydraulic rod, and a hydraulic rod ear fixedly disposed at a top end of the hydraulic rod, a bottom end of the transmission mechanism is fixedly connected with a support rod, and the support rod and the hydraulic rod ear are pivotally connected to each other, wherein the support rod is provided with a through hole, the locking device includes a pull bolt, and the pull bolt is configured to be inserted into the through hole on the support rod to lock the position of the transmission mechanism.

In an embodiment, the rain cover assembly further comprises an additional locking device connected between any two adjacent cover plates, the additional locking device is fixedly mounted on one of the two adjacent cover plates, and the additional locking device is releasably fixed with the other of the two adjacent cover plates.

In an embodiment, the two adjacent cover plates are a first cover plate and a second cover plate, the second cover plate is provided with a metal rim, and the additional locking device comprises:

a mounting plate fixedly connected to the first cover plate and protruding toward the second cover plate;

a magnet disposed on a portion of the mounting plate protruding from the first cover plate, and the magnet and the metal rim of the second cover plate facing each other.

In an embodiment, the additional locking device further comprises:

a U-shaped pressing plate whose both ends are detachably connected to a surface of the mounting plate facing the second cover plate, so that the magnet is cooperatively received in a space jointly defined by the U-shaped pressing plates and the pressing plate;

an ejector rod penetrating through a through hole on the mounting plate and configured to be locked relative to the mounting plate, and configured to press the magnet in a direction towards the second cover plate so that the magnet can be pressed tightly between the ejector rod and U-shaped pressing plate.

In an embodiment, an arcuate segment bent towards the second cover plate is disposed at an end of the mounting plate opposite to an end fixed on the first cover plate, and a size of the arcuate segment in a thickness direction of the mounting plate is smaller than a size of the magnet in the thickness direction of the mounting plate.

In an embodiment, one of the cover plates comprises the intermediate plate and the two side plates, and the other is s a single plate structure.

In an embodiment, each of the cover plates comprises the intermediate plate and the two side plates, and corresponding side plates of the two cover plate partially overlap when at the open position.

In an embodiment, the rain cover assembly comprises only one set of cover plate assembly, and the cover plate in the cover plate assembly comprises:

a pipe-shaped structure configured to translate relative to the pipe along an extension direction of the pipe;

a covering plate disposed at one end of the pipe-shaped structure and configured to pivot relative to the pipe-shaped structure to open and close the pipe-shaped structure, the cover plate is configured in a way that when the cover plate is at the open position, the pipe-shaped structure is formed as the additional pipe structure, and the covering plate is located outside or inside the pipe-shaped structure; when the cover plate is at a closed position, the pipe-shaped structure is sleeved inside or outside the pipe, and the covering plate shields the opening of the pipe-shaped structure.

In an embodiment, one end of the covering plate is connected to the pipe, and the other end of the covering plate is connected to the pipe-shaped structure via an articulation lever.

Another object of the present disclosure is to provide a pipe assembly comprising a pipe with an upward opening and the rain cover assembly according to any one of the above solutions.

In an embodiment, the pipe assembly further comprises a mounting frame fixed on the pipe, the rain cover assembly comprising a power mechanism mounted on the mounting frame.

In an embodiment, the pipe is an L-shaped pipe.

A further object of the present disclosure is to provide a turbine fracturing unit, comprising a turbine engine and an exhaust muffler mounted at an exhaust port of the turbine engine. The rain cover assembly is the rain cover assembly according to any of the above solutions.

In an embodiment, the turbine fracturing unit further comprises a control device, the rain cover assembly on the exhaust muffler comprises a power mechanism, a position sensor communicatively connected with the control device is integrated in the power mechanism, the position sensor is configured to sense a position state of the cover plate of the rain cover assembly, and the control device is configured to disable the state of the turbine engine when the position sensor monitors the cover plate is at the closed position.

According to this solution, the arrangement of the control device and the detection device enables the turbine engine to start only when the cover plate is in the open state so that the safety factor of the turbine fracturing unit can be improved.

In an embodiment, the turbine fracturing unit further comprises a diffuser duct connected between the pipe and the turbine engine.

BRIEF DESCRIPTION OF THE DRAWINGS

Reference may be made to preferred embodiments shown in the figures to enable better understanding of the above and other objects, features, advantages and functions of the present disclosure. The same reference numerals in the figures denote the same parts. Those skilled in the art should appreciate that the figures are intended to schematically illustrate the preferred embodiments of the present disclosure, and not intended to impose any limitations to the scope of the present disclosure. All parts in the figures are not drawn to scale.

LISTING OF REFERENCE NUMBERS

Figure 1:
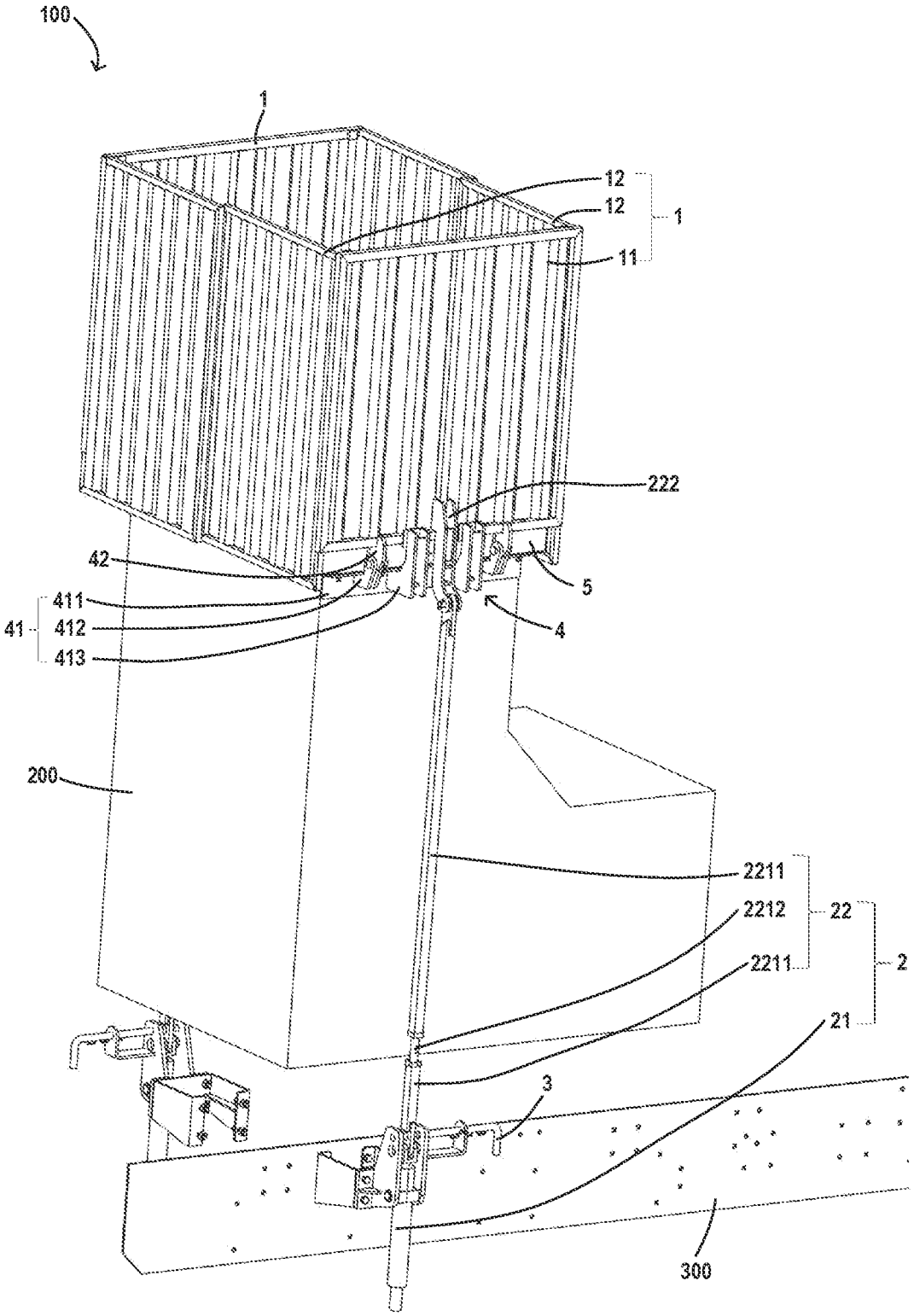
FIG. 1 shows a schematic view in which a rain cover assembly is mounted on a pipe according to a preferred embodiment of the present disclosure, wherein a cover plate of the rain cover assembly is at an open position.

100, 700 Rain cover assembly
1, 83, 84 Cover plate
11 Intermediate plate
12, 831, 841 Side plates
2 Driving device
21 Power mechanism
22 Transmission mechanism
222 Forced ear
223 Second pin
2211 First rod portion
2212 Second rod portion
231 Support rod
232 Hydraulic rod ear
233 Second pivot
234 Clamp plate
235 First pivot
236 Hydraulic cylinder
237 Hydraulic lever
3 Locking device
4 Connecting member
41 Base
42 Pivoting portion
43 First pin
411 Base plate
412 Ear
4121 Pivot mounting hole
413 Limiting portion
4131 Extension plate
4132 Limiting plate
5 Baffle
200, 800 Pipe
300 Mounting plate
400 Control device
500 Position sensor
600 Turbine engine
601 Diffuser duct
71, 81 First cover

72, 82 Second cover
73 Additional locking device
731 Mounting plate
732 Ejector rod
733 Magnet
734 U-shaped pressing plate
7311 Arcuate segment
851 Pipe-shaped structure
852 Covering plate
852*a* One end of the covering plate
852*b* The other end of the covering plate
853 Articulation lever

DETAILED DESCRIPTION OF EMBODIMENTS

Specific embodiments of the present disclosure will now be described in detail with reference to the figures. Those having ordinary skill in the art can implement other manners of the present disclosure on the basis of the preferred embodiments, and said other manners also fall within the scope of the present disclosure.

FIG. 1-FIG. 5 show example embodiments of a rain cover assembly and a pipe mounted with the rain cover assembly according to the present disclosure.

First, referring to FIG. 1, the rain cover assembly 100 is mounted on an open end of a pipe 200. The pipe 200 may be, for example, an exhaust port of a turbine engine mounted in a turbine fracturing unit, or an exhaust muffler mounted at an exhaust port. The rain cover assembly 100 includes two sets of cover plate assemblies. Taking the set of cover plate assembly shown roughly in FIG. 1 as an example, each set of cover plate assembly substantially includes a cover plate 1, a power mechanism 21, a transmission mechanism 22 and a locking device 3.

As shown in FIG. 1, in the present embodiment, the pipe 200 opens upward. First of all, it needs to be appreciated that "a centerline of the pipe" mentioned in the text herein is a straight line which is perpendicular to a plane where the opening of the pipe is located and passes through the center of the opening.

The cover plate 1 is mounted at the open end of the pipe 200 and capable of pivoting in a vertical plane between a closed position where the cover plate covers the opening and an open position where the cover plate exposes the opening. It may be appreciated that its pivot axis is perpendicular to the centerline of the pipe 200. It needs to be clarified that when the cover plate 1 is at the closed position, the entire opening may be covered or only a portion of the opening may be covered; when all the cover plates 1 are at the closed position, they may jointly cover the opening of the cover 200 completely. One end of the transmission mechanism 22 is connected to the cover plate 1 and can drive the cover plate 1 to pivot between the open position and the closed position. The other end of the transmission mechanism 22 is indirectly connected to the locking device 3 through the power mechanism 21, and is configured to lock the transmission mechanism 22 and thereby lock the cover plate 1 when the cover plate 1 is at the open position. Certainly, it is also possible that there is not a power mechanism 21, and the transmission mechanism 22 is directly connected to the locking device 3. At this time, manual operation is required.

Figure 3:
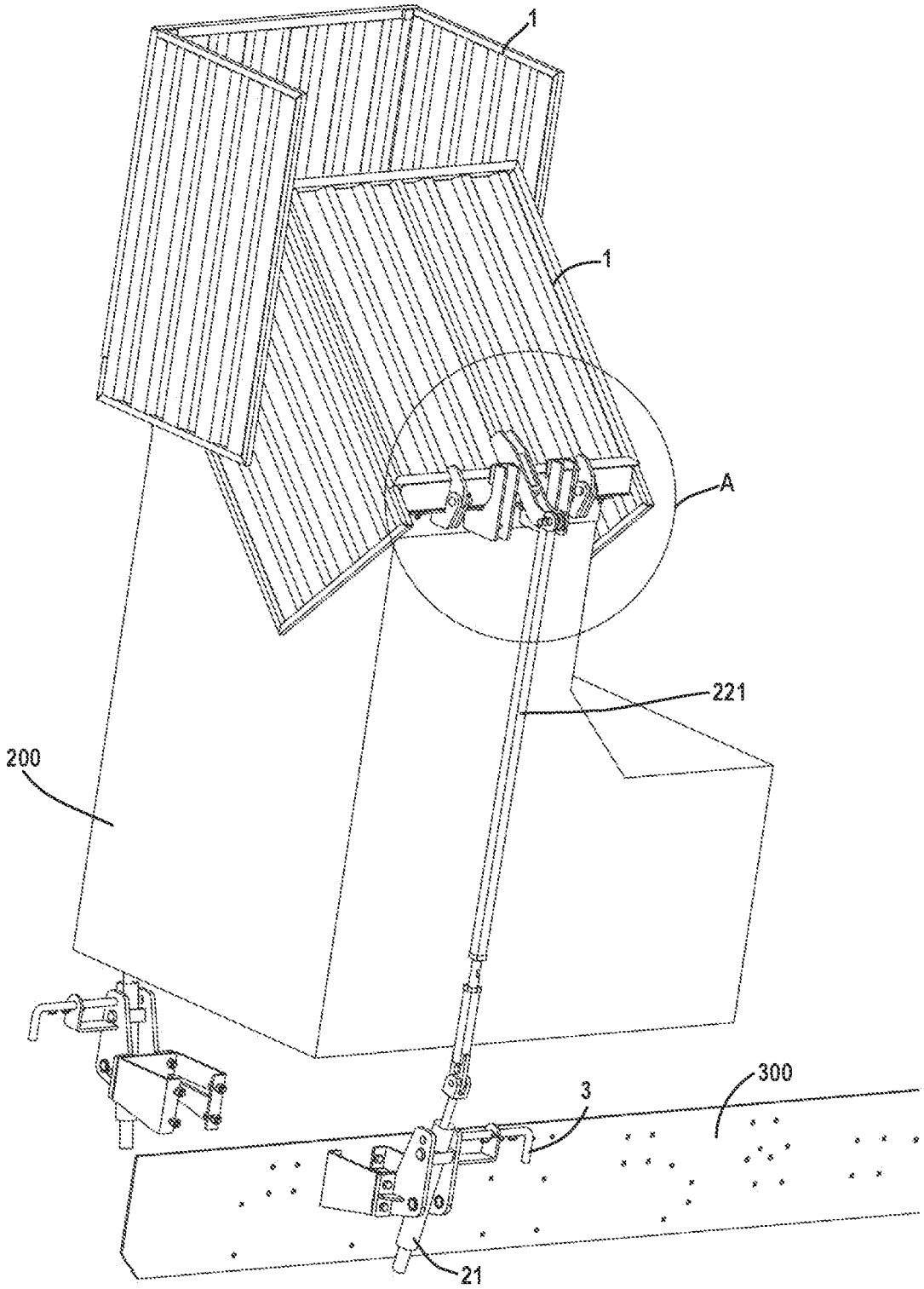
FIG. 3 is a view of another state of the structure shown in FIG. 1, wherein the cover plate of the rain cover assembly is located at an intermediate position between an open position and a closed position.
Figure 5:
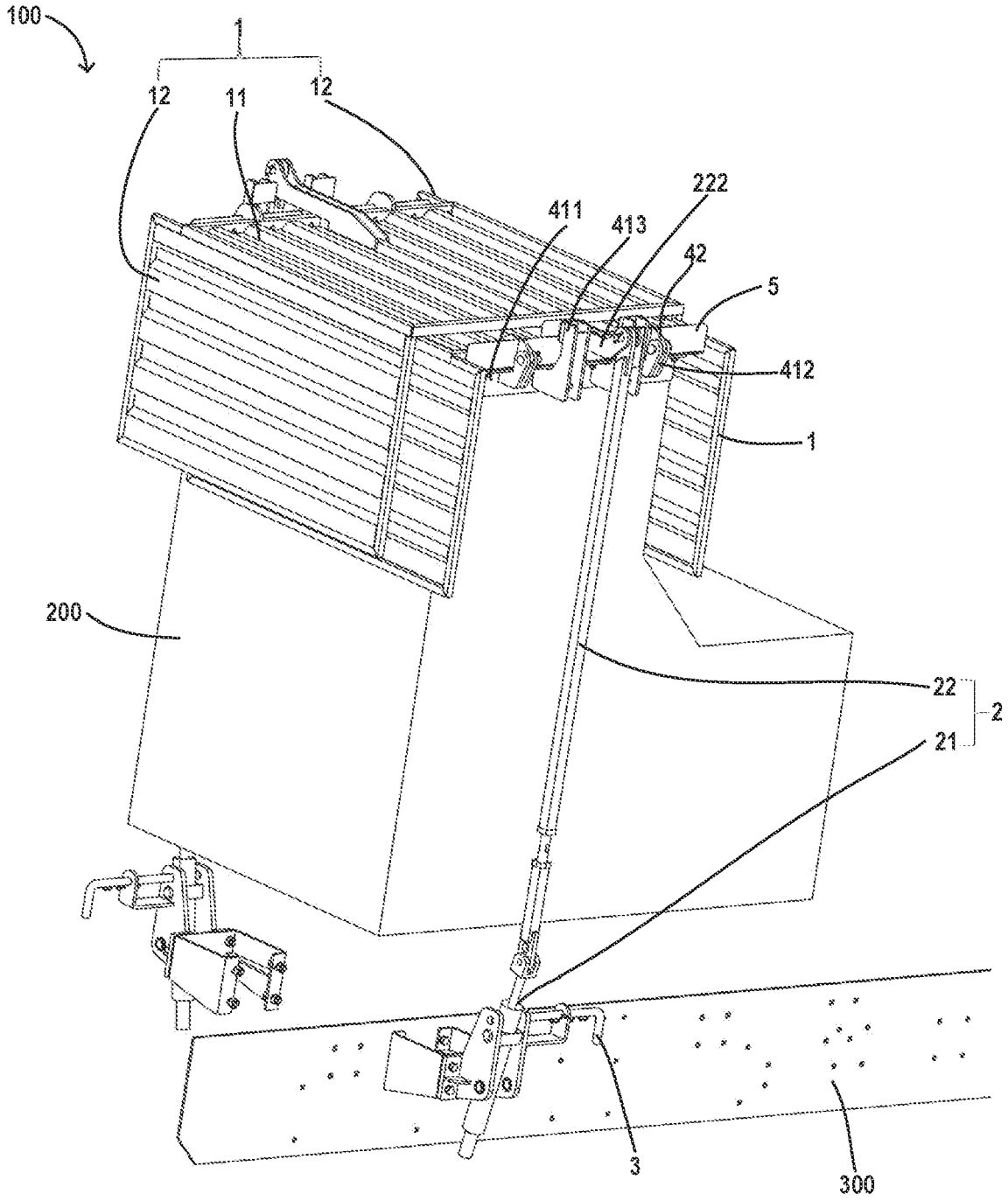
FIG. 5 is a view of a further state of the structure shown in FIG. 1, wherein the cover plate of the rain cover assembly is at the closed position.

Continuing to refer to FIG. 1, FIG. 3 and FIG. 5, the cover plates 1 of the two cover plate assemblies are symmetrically arranged about the opening, and each cover plate 1 includes an intermediate plate 11 and two side plates 12 respectively connected to the two opposite endings of the intermediate plate 11, wherein the intermediate plate 11 is perpendicular to the side plates 12. As shown in FIG. 1, when the two cover plates 1 are at the open position, the intermediate plate 11 and the side plates 12 of each cover plate 1 all extend in the vertical direction, and the two cover plates 1 jointly form a closed additional pipe structure which is open at both ends and extends in the vertical direction. The additional pipe structure is located above the pipe 200 and communicated with the opening of the pipe 200. The shape of the additional pipe structure is similar to a chimney mounted at the top end of the pipe 200. As shown in FIG. 5, when the two cover plates 1 are at the closed position, the intermediate plate 11 of each cover plate 1 covers the opening and the side plates 12 abut against the outside of the wall surfaces of the pipe 200. More specifically, the intermediate plates 11 of the two cover plates 1 covers the opening overlappingly.

In an embodiment not shown, the rain cover assembly may include more cover plate assemblies, the cover plates of respective cover plate assemblies are evenly arranged around edges of the opening, and the cover plates of respective cover plate assemblies are configured in a way that when the cover plates are at the open position, the cover plates are connected end-to-end around the horizontal direction (or may be partially overlapped) to form a closed additional pipe structure which extends in the vertical direction with both ends open. The additional pipe structure is located above the pipe and continutes along the opening of the pipe. When the cover plate of each cover plate assembly is at the closed position, the cover plates at least partially overlap.

Each cover plate assembly further includes a connecting member 4 connecting the cover plates 1 with the pipe 200.

Figure 2:
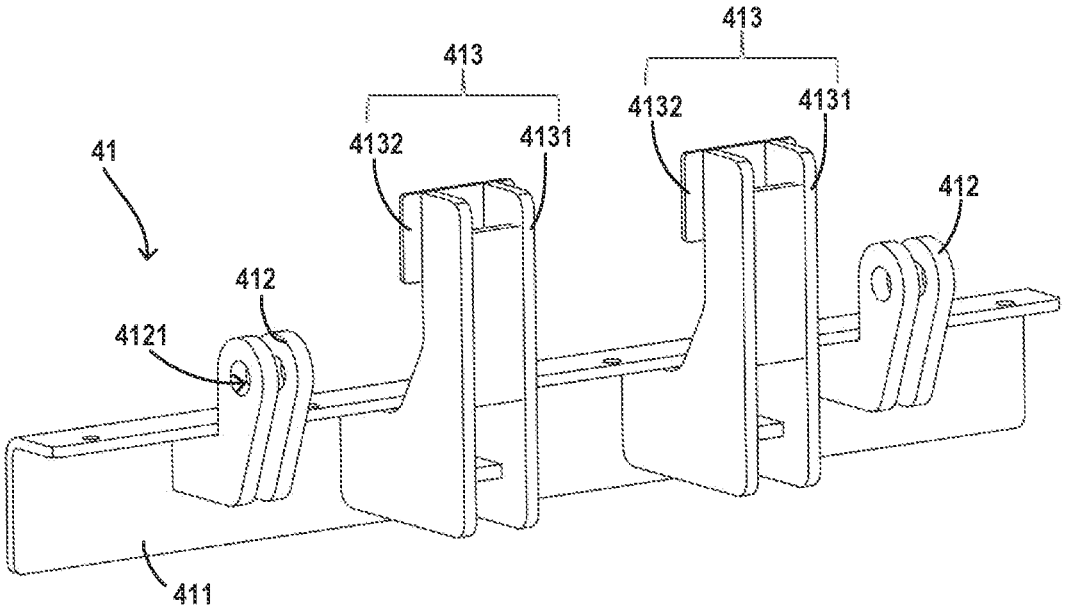
FIG. 2 is an enlarged view of partial structures of a connecting member in the rain cover assembly shown in FIG. 1.
Figure 4:
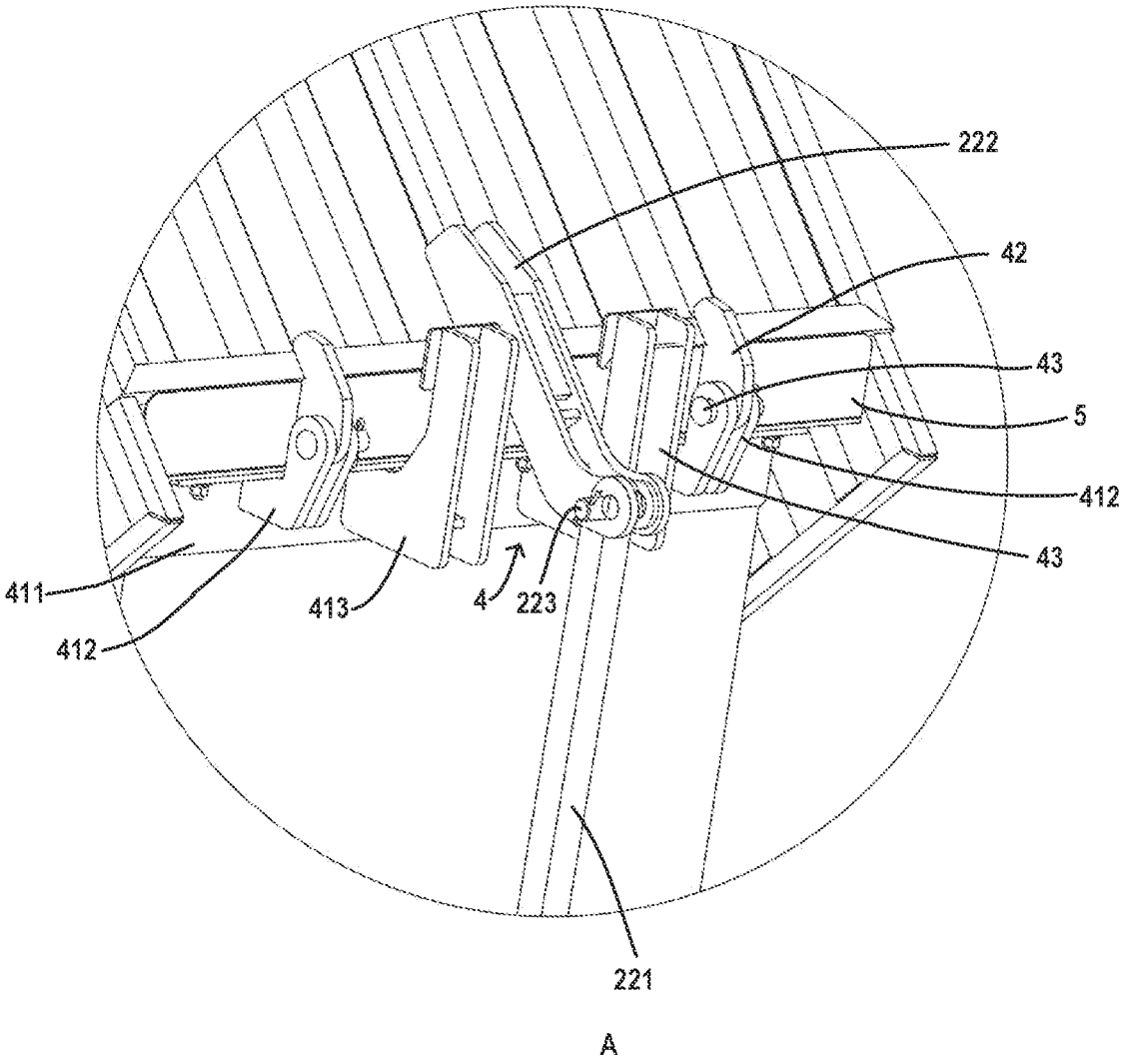
FIG. 4 is a partially enlarged view of portion A of FIG. 3.

Referring to FIG. 2 and FIG. 4, a base 41 of the connecting member 4 is an integral member formed by welding. The base 41 is fixedly mounted on the pipe 200, and a pivoting portion 42 is pivotally connected with the base 41 via a first pin 43 (see FIG. 4). The pivoting portion 42 is fixed on the cover plate 1 and can pivot together with the cover plate 1 relative to the base 41 (i.e., relative to the pipe 200). Further, the base 41 further includes a base plate 411, an ear 412 and a limiting portion 413. A portion of the base plate 411 is parallel to the pivot axis of the cover plate 1 and abuts the outer wall of the pipe 200. The ear 412 extends away from the pipe. The ear 412 is formed with a pivot shaft mounting hole 4121, and the pivoting portion 42 is a plate-shaped structure and mounted together with the ear 412 by the first pin 43 penetrating through the pivot mounting hole 4121. Preferably, one ear 412 includes two plate-shaped structures, and the pivoting portion 42 is correspondingly sandwiched between the two plate-shaped structures.

The arrangement of such as connecting member 4 can facilitate the proper connection between the cover plate 1 and the pipe 200, and not only ensures the connection strength of the two, but also provides the flexibility of the cover plate 1 relative to the pipe 200.

In some example implementations, the limiting portion 413 is configured in a way that the limiting portion 413 abuts against the cover plate when the cover plate 1 pivots to the open position, to limit further pivoting of the cover plate 1. A state when the limiting portion 413 limits the cover plate 1 to the open position is shown in FIG. 1. Referring to FIG. 2, the limiting portion 413 for example may include an extension structure 4131 extending upward from the base plate 411 and a limiting plate 4132 mounted on the extension structure 4131 and facing the cover plate 1. The arrangement of the limiting portion 413 can limit the excessive movement of the cover plate 1 relative to the pipe 200, thereby ensuring the connection strength between the cover plate 1 and the pipe 200, and preventing the cover plate 1 from being disconnected from the pipe 200 due to excessive movement, and in the meanwhile can facilitate the formation of the closed additional pipe.

In some example implementations, the rain cover assembly 100 further includes a baffle 5 fixed relative to the pipe 200 and extending along a connection gap between the pipe 200 and the cover plate 1 to cover the gap. The baffle 5 may be fixed together with the connecting member 4.

Referring to FIG. 1, FIG. 3 and FIG. 5, the power mechanism 21 and the transmission mechanism 22 jointly function as a driving device 2. The transmission mechanism 22 further includes a transmission rod engaged with the power mechanism 21. A forced ear 222 is disposed on the cover plate, and the forced ear 222 is pivotally connected with the transmission rod via a second pin 223 (see FIG. 4). The power mechanism 21 can drive the transmission rod to move substantially up and down, and drive the forced ear 222 to drive the cover plate 1 to pivot.

As described above, the forced ear 222 of the driving device 2 and the pivoting portion 42 of the connecting member 4 are both fixed on the cover plate 1, and the three move jointly. In the joint movement of the forced ear 222 and the cover plate 1, the forced ear 222 is a driving member, and the cover plate 1 is a driven member. In the joint movement of the cover plate 1 and the pivoting portion 42, the cover plate 1 is a driving member, and the pivoting portion 42 is a driven member.

In some example implementations, the length of the transmission rod of the driving device 2 is adjustable. For example, the transmission rod includes a first rod portion 2211 and a second rod portion 2212, and the second rod portion 2212 is sleeved in two adjacent first rod portions 2211 to form a telescopic structure. Such a telescopic structure may be realized by any suitable mechanism in the prior art.

The power mechanism 21 may include an electric power mechanism or a pneumatic power mechanism, which includes, for example, an electric cylinder or a hydraulic cylinder. For example, the transmission mechanism 22 may be provided with a gear-rack mechanism, a cam mechanism, an electric winch mechanism, etc., in addition to or an alternative to the transmission rod for transmission.

When the rain cover assembly is applied to a small pipe, the cover plate may be opened and closed manually. In such an embodiment, the rain cover assembly may only include the transmission mechanism and not include the power mechanism, and the end of the transmission mechanism opposite to the cover plate may be set to be directly connected to a locking device to lock the cover plate at a predetermined position.

The locking device 3 may include the pull bolt shown in the figure(s). During the opening and closing of the cover plate 1, the pull bolt may be pulled outward to make the driving device 2 operable. When the cover plate 1 reaches the open position, the pull bolt may be inserted into a bolt hole to lock the driving device 2 to further lock the cover plate 1 at the open position. When the cover plate 1 is at the closed position, the locking device 3 may lock the driving device 2, or may keep an unlocked state so that the cover plate 1 may rest at the closed position freely.

Figure 6:
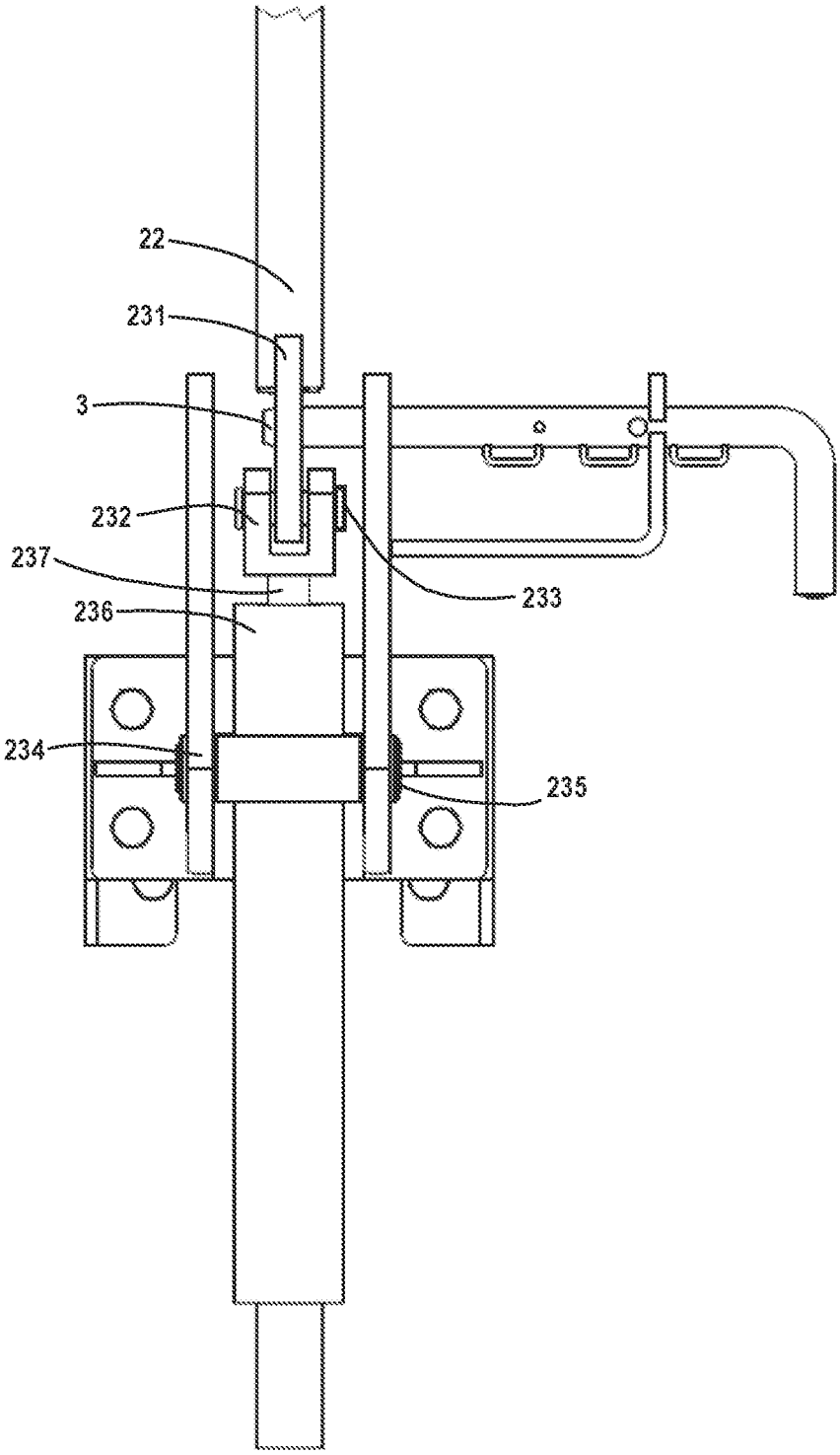
FIG. 6 is a front view at a power mechanism and a locking device in FIG. 1.

FIG. 6 shows an example of a specific cooperation relationship between the power mechanism 21 and the locking device 3. Referring to FIG. 6, the power mechanism 21 includes a hydraulic cylinder 236, a hydraulic rod 237, and a hydraulic rod ear 232 fixedly disposed at a top end of the hydraulic rod 237. A bottom end of the transmission mechanism 22 is fixedly connected with a support rod 231, and the support rod 231 and the hydraulic rod ear 232 are pivotally connected to each other by a second pivot 233. Furthermore, clamp plates 234 parallel to each other are disposed fixedly relative to the pipe, the hydraulic cylinder 236 is mounted between the two clamp plates 234 via the first pivot 235, and the first pivot 235 is parallel to the second pivot 233. When the hydraulic cylinder operates, the hydraulic cylinder 236 can rotate about the first pivot 235 relative to the pipe, and meanwhile, the support rod 231 rotates about the second pivot 233 relative to the hydraulic rod ear 232.

Furthermore, the support rod 231 is provided with a through hole, the locking device 3 includes a pull bolt, and the pull bolt can be inserted into the through hole on the support rod 231 to lock the position of the transmission mechanism 22. After the locking device 3 locks the position of the transmission mechanism 22, the hydraulic cylinder is in an unstressed state.

Figure 7:
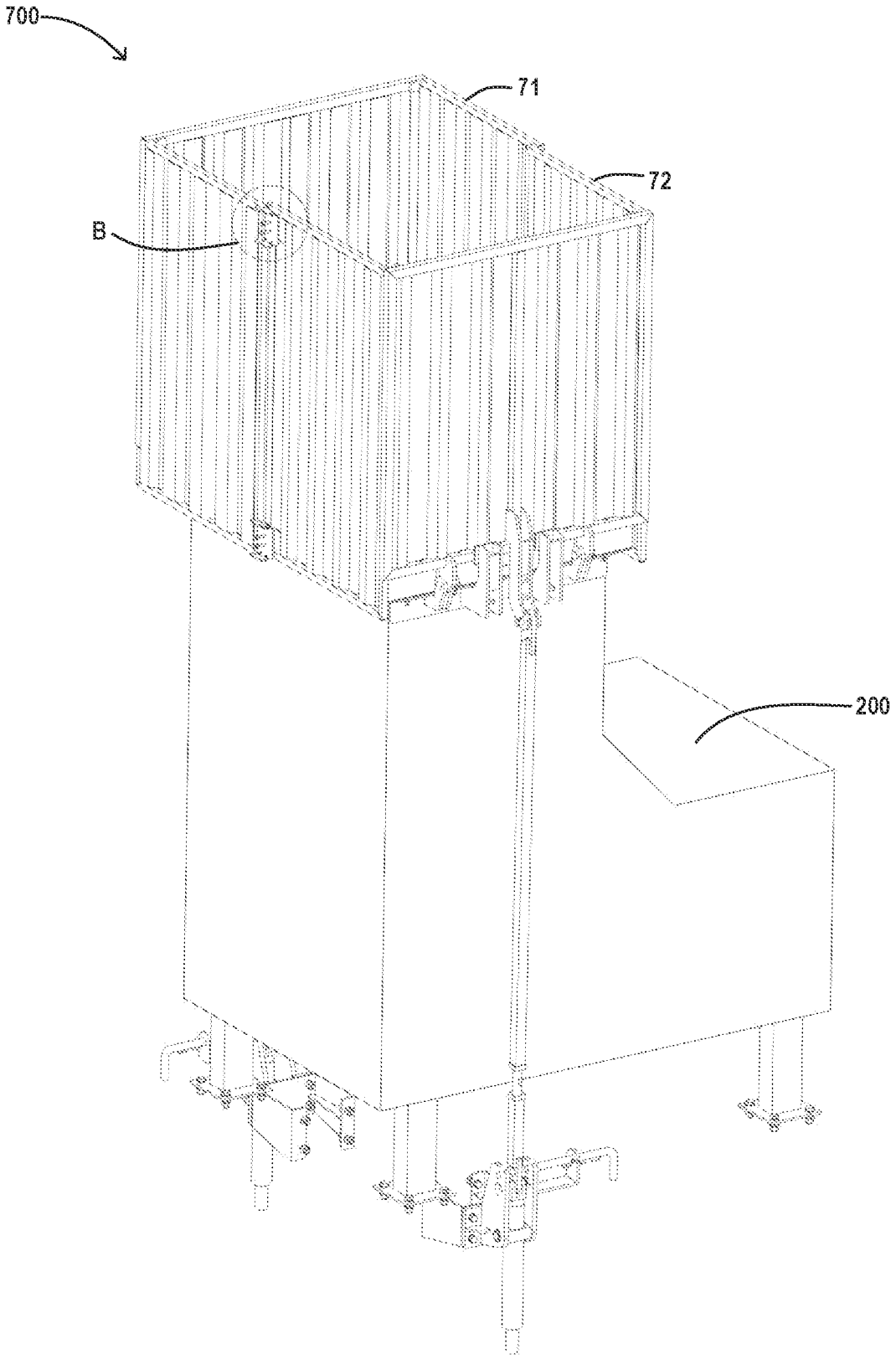
FIG. 7 shows a schematic view in which a rain cover assembly is mounted on a pipe according to another preferred embodiment of the present disclosure, wherein the cover plate of the rain cover assembly is at an open position.
Figure 8:
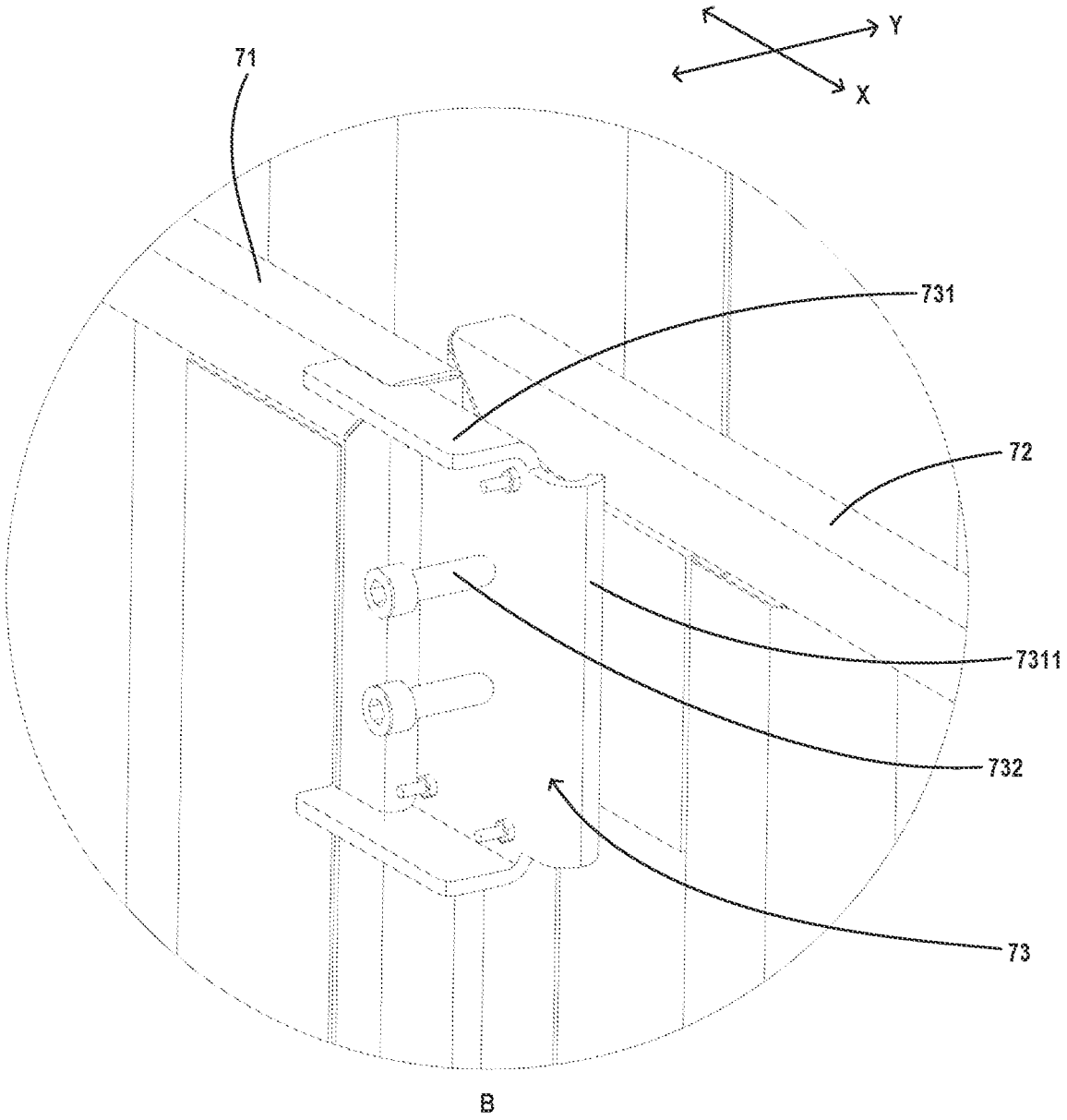
FIG. 8 is a partially enlarged view of portion B of FIG. 7.
Figure 9:
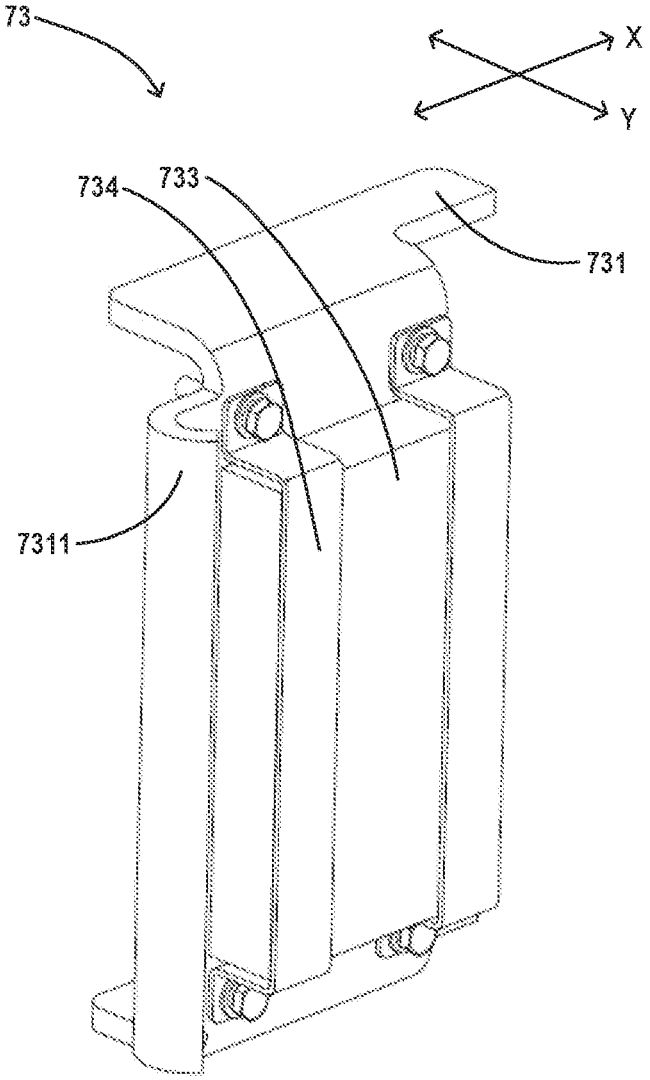
FIG. 9 is a perspective space view of another view of an additional locking device in FIG. 8 from another perspective.

In addition to the above arrangement, the rain cover assembly may further include some other structures. For example, in the embodiment shown in FIG. 7 and FIG. 8, the rain cover assembly 700 further includes an additional locking device 73 arranged between two adjacent cover plates. The additional locking device 73 can be used to fix the two adjacent cover plates relative to each other when the cover plate is at the open position, to prevent the cover plate from vibration and popping during transportation and operation. An example of a specific structure of the additional locking device 73 is shown in FIG. 8 and FIG. 9. The additional locking device 73 is fixedly connected to one of the two adjacent cover plates, and releasably fixed with the other of the two adjacent cover plates. For the ease of description, the two adjacent cover plates shown in FIG. 7 and FIG. 8 are referred to as a first cover plate 71 and a second cover plate 72.

Referring to FIG. 8 and FIG. 9, the additional locking device 73 includes a mounting plate 731, a magnet 733, a U-shaped pressing plate 734 and ejector rods 732. The mounting plate 731 is fixedly connected to the first cover plate 71 and protrudes toward the second cover plate 72 along an X direction. The X direction is parallel to the side plates of the first cover plate 71 and the second cover plate 72. The second cover 72 has a metal rim. The magnet 733 is provided on a portion of the mounting plate 731 that protrudes from the first cover plate 71, and the magnet 733 and the metal rim of the second cover plate 72 face each other in a Y direction. The Y direction is perpendicular to the side plates of the first cover plate 71 and the second cover plate 72. The magnet 733 is a high temperature-resistant and high-strength magnet, and can withstand high-temperature exhaust gas discharged from the turbine engine.

Furthermore, there are two U-shaped pressing plates 734, and both ends of each U-shaped pressing plate 734 are detachably connected to the surface of the mounting plate 731 facing the second cover plate 72, so that the magnet 733 is cooperatively received in a space jointly defined by the U-shaped pressing plates 734 and the mounting plate 731. The two U-shaped pressing plates 734 are arranged along the X direction. The U-shaped pressing plates 734 can function to protect the magnet 733 and avoid damages to the magnet caused by direct collision and contact between the magnet 733 and the second cover 72.

Furthermore, the mounting plate 731 is provided with through holes. The ejector rods 732 run through the through holes and can be locked relative to the mounting plate 731. The ejector rods 732 can press the magnet 733 in the Y direction, so that the magnet 733 can be pressed tightly between the ejector rods 732 and U-shaped pressing plates 734. There are two ejector rods 732, and the two ejector rods 732 are arranged in a direction perpendicular to both the X direction and the Y direction.

Since the U-shaped pressing plates 734 are detachable, U-shaped pressing plates 734 of different sizes may be selected according to actual needs. For example, U-shaped pressing plates having a larger size in the Y direction than the U-shaped pressing plates 734 shown in FIG. 9 may be selected. After that selected U-shaped pressing plates are mounted on the mounting plate 731 and the magnet 733 is placed in the space jointly defined by the U-shaped pressing plates 734 and mounting plate 731, the ejector rods may be screwed tightly to press the magnetic 733 between the U-shaped pressing plates and the ejector rods 732. At this time, there may be a certain gap between the magnet 733 and the mounting plate 731, and therefore, the magnet 733 might be closer to the metal rim of the second cover plate 72, thereby generating a greater attractive force to the second cover plate 72. In other words, the distance between the two cover plates can be made in an optimal state by replacing U-shaped pressing plates of different sizes.

In some example implementations, the edge of the mounting plate 731 is provided with an arcuate segment 7311 bent toward the second cover plate 72. The arcuate segment 7311 is provided to prevent the magnet 733 from being hit by other components. The size of the arcuate segment 7311 in a thickness direction of the mounting plate 731 (i.e., the Y direction) is smaller than the size of the magnet 733 in the thickness direction of the mounting plate 731, so the arcuate segment 7311 will not interfere with the second cover plate 72.

The cover plate of the rain cover assembly according to the present disclosure may also have various structural forms. For example, instead of the cover structure shown in FIG. 1 and FIG. 7, FIG. 10A-FIG. 10D show top views of cover plates of several rain cover assemblies in an open state. The embodiments shown in FIG. 10A through FIG. 10C all include two cover plates.

Figure 10A:
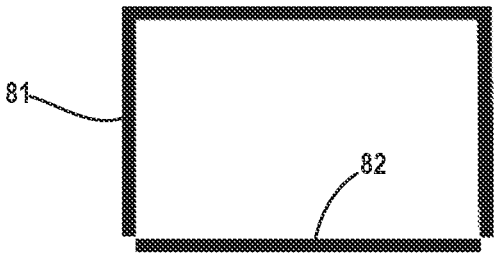
FIG. 10A-FIG. 10C are schematic diagrams of top views of several alternative solutions of the cover plate in FIG. 1 and FIG. 7, the cover plate being at the open position in FIG. 10A-FIG. 10C.

In FIG. 10A, the first cover plate 81 includes an intermediate plate and two side plates, the second cover plate 82 is a single plate structure, and the intermediate plate, two side plates of the first cover plate 81 and the second cover plate 82 can jointly form an additional pipe structure.

Figure 10B:
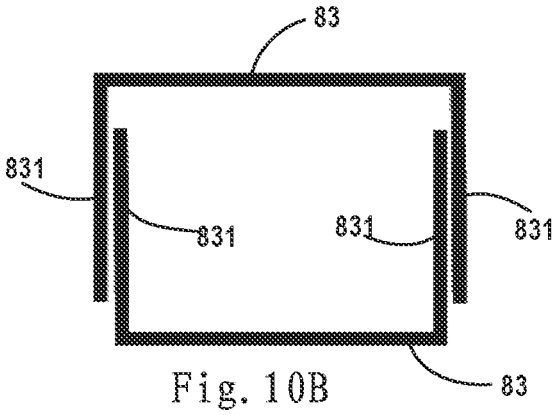

In FIG. 10B, each cover plate 83 includes an intermediate plate and two side plates 831, and the corresponding side plates 831 of the two cover plates 83 partially overlap when at the open position. The two side plates 831 of one cover plate 83 are both located inside the two side plates 831 of the other cover plate 83.

Figure 10C:
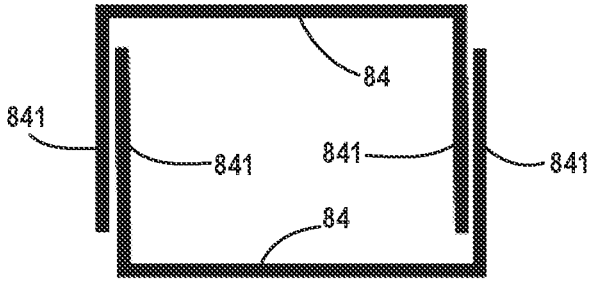

In FIG. 10C, each cover plate 84 includes an intermediate plate and two side plates 841, and the corresponding side plates 841 of the two cover plates 84 partially overlap when at the open position. One side plate 841 of one cover plate 84 is located inside one side plate 841 of the other cover plate 84; the other side plate 841 of the one cover plate 84 is located outside the other side plate 841 of the other cover plate 84.

The rain cover assembly may further include only one set of cover plate assembly. For example, in FIG. 10D, the cover plate in the set of cover plate assembly includes a pipe-shaped structure 851 and a covering plate 852. The pipe-shaped structure 851 can translate relative to the pipe along an extension direction of the pipe; the covering plate 852 is disposed at one end of the pipe-shaped structure 851 and can pivot relative to the pipe-shaped structure 851 to open or close the pipe-shaped structure 851. The cover plate is configured such that when the cover plate is at the open position, the pipe-shaped structure 851 is formed as an additional pipe structure, and the covering plate 852 abuts against the outside or inside of the pipe-shaped structure 851; when the cover plate is at the closed position, the pipe-shaped structure 851 is sleeved inside or outside the pipe, and the covering plate 852 covers the opening of the pipe-shaped structure.

Figure 10D:
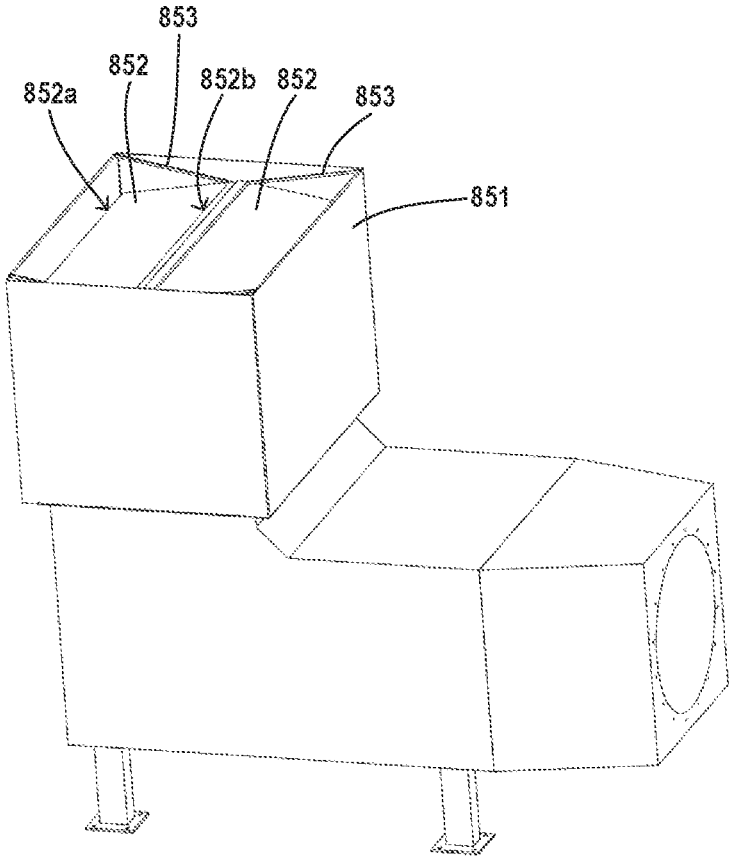
FIG. 10D and FIG. 10E are perspective space views of another alternative embodiment of the cover plate assembly of FIG. 1.
Figure 10E:
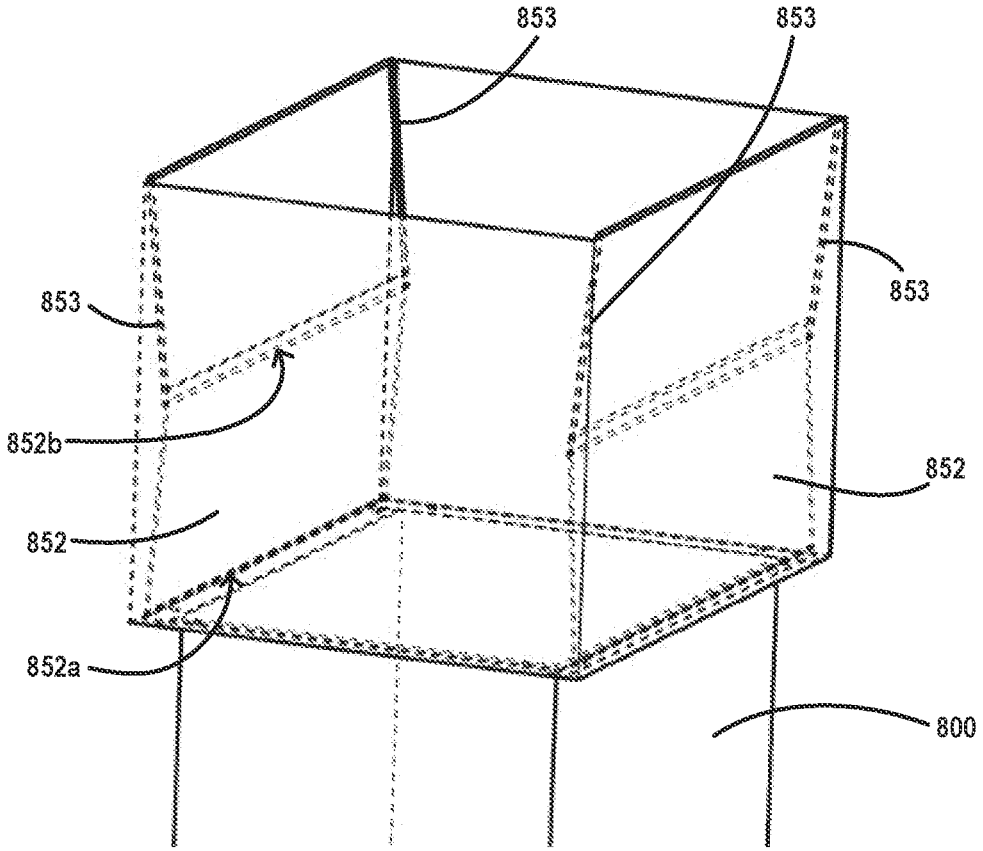

A more specific example structure of the above solution is shown with reference to FIG. 10D and FIG. 10E. In such example implementations, there are two covering plates 852, one end 852*a* of each covering plate is connected to the pipe, and the other end 852*b* of the covering plate is connected to the pipe-shaped structure 851 through an articulation lever 853. Such an arrangement makes it possible to make the covering plate 852 opened when the pipe-shaped structure 851 moves upwards and thereby drives the other end 852*b* of the covering plate to move upwards simultaneously.

When the opening of the pipe 800 needs to be exposed, when the pipe-shaped structure 851 moves upward relative to the pipe 800, the other end 852*b* of the covering plate 852 is indirectly driven by the pipe-shaped structure 851 via the articulation lever 853 to pivot upwards, and one end 852*a* of the cover plate is always fixed relative to the pipe 800 in this process so that the covering plate 852 is opened (approximately as shown in FIG. 10E).

When the opening of the pipe 800 needs to be covered, when the pipe-shaped structure 851 moves downward relative to the pipe 800, the pipe-shaped structure 851 drives the other end 852*b* of the covering plate 852 to pivot downward via the articulation lever. In this process, the one end 852*a* of the covering plate is always fixed relative to the pipe 800 so that finally the covering plate 852 covers the opening of the pipe 800 (approximately as shown in FIG. 10D).

In addition to the above-mentioned pivotal movement and translational movement, in other unshown embodiments, the cover plate may also include pivotal movements in other directions. For example, there may be a section of pivotal movement during the pivoting of the cover plate, and the pivot axis of the pivotal movement is parallel to a centerline of the pipe. In other words, a pivot axis may be added to one of the cover plates. For example, when the cover plates needs to be closed, one cover plate may be pivoted horizontally to a position overlapping with the other cover plate, and then the two overlapping cover plates may be pivoted together around an axis perpendicular to the centerline of the pipe.

The figure also shows a mounting frame 300 fixed on the pipe 200, and the driving device 2 of the rain cover assembly 100 is mounted on the mounting frame 300.

Figure 11:
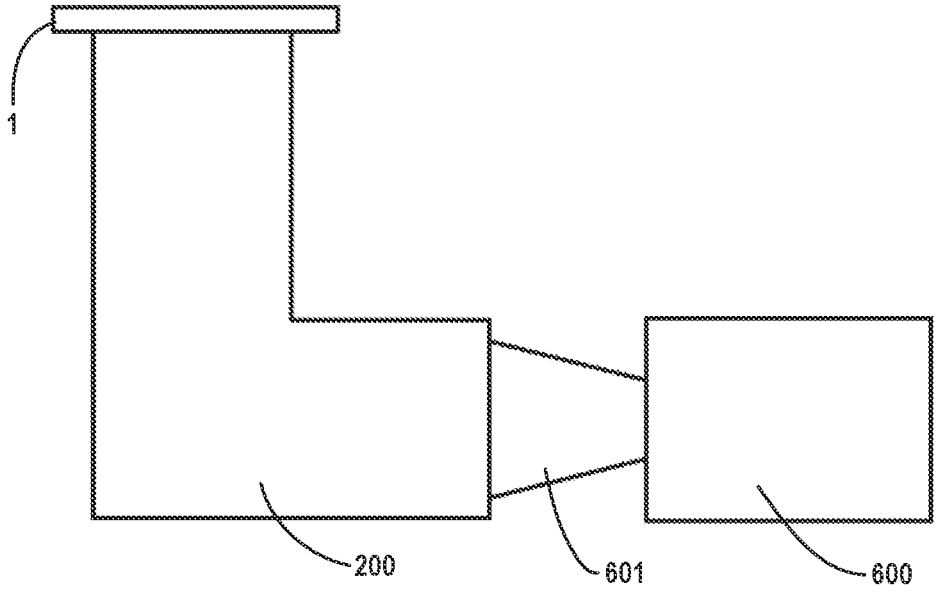
FIG. 11 is a schematic diagram of a connection state of a turbine engine, a diffuser duct and a pipe according to a preferred embodiment of the present disclosure.

In particular, the present disclosure further provides a turbine fracturing unit, which includes a turbine engine and an exhaust muffler mounted at the exhaust port of the turbine engine. The exhaust muffler may be the pipe 200 described in the above embodiment. Further, as shown in FIG. 11, the turbine fracturing unit includes a turbine engine and a tapered diffuser duct connected between the turbine engine and the pipe 200. The pipe 200 may be an L-shaped pipe. One section of the L-shaped pipe extends horizontally and the other section extends vertically. The cover plate 1 covers an opening at the top end of the vertically extending section. The setting of the L-shaped pipe enables exhaust gas to be discharged after passing by a 90° corner.

Figure 12:
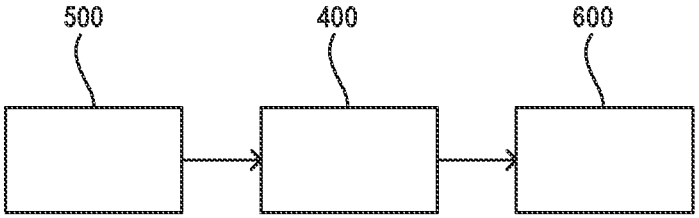
FIG. 12 is a diagram representing a communication relationship between a control device, a position sensor and a turbine engine according to a preferred embodiment of the present disclosure.

Referring FIG. 12, the turbine fracturing unit may further include a control device 400, and a position sensor 500 communicatively connected with the control device 400 is integrated in the power mechanism 21 of the rain cover assembly 100 on the exhaust muffler. The communication relationship among the control device 400, the position sensor 500, and the turbine engine 600 is shown in FIG. 6. The position sensor 500 is configured to sense the positional state of the cover plate 1 of the rain cover assembly 100 and send a sensing signal to the control device 400. For example, when the power mechanism 21 is a hydraulic cylinder, the position sensor 500 may be arranged adjacent to a piston or a piston rod in the hydraulic cylinder and can sense the displacement of the piston or piston rod. The control device 400 is configured to send a control signal to the turbine engine 600 when analyzing according to the received signal to determine that the cover plate 1 is at the closed position to disable the start of the turbine engine 600. In other words, the control device 400 allows the turbine engine 600 to be activated only when the cover plate 1 is at the open position; when the cover plate 1 is at the closed position, the turbine engine 600 cannot be activated, thereby improving the safety factor of the turbine fracturing unit.

According to the above solution, it may be understood that the rain cover assembly according to the present disclosure has at least two cover plate assemblies, which, when opened, will jointly form a closed additional pipe structure connected to the open end of the pipe to guide the exhaust gas of the pipe to a further space. Such an arrangement may reduce noise on the one hand, and prevent backflow of the exhaust gas on the other hand. The cover plates, when closed, can shield the opening of the pipe to prevent entry of rainwater.

The above depictions of various embodiments of the present disclosure are provided to those having ordinary skill in the art for depiction purpose, and are not intended to exclude other embodiments from the present disclosure or limit the present disclosure to a single disclosed embodiment. As described above, various alternatives and modifications of the present disclosure will be apparent to those of ordinary skill in the art. Accordingly, although some alternative embodiments have been described in detail, those having ordinary skill in the art will understand or readily develop other embodiments. The disclosure is intended to cover all alternatives, modifications and variations of the present disclosure described herein, as well as other embodiments falling within the spirit and scope of the present disclosure described herein.

We claim:

1. A cover assembly mounted on an opening of a pipe (200), comprising at least one set of cover plate assembly, wherein each set of cover plate assembly comprises:

a cover plate (1) mounted on the opening of the pipe (200) and being movable relative to the pipe (200) between a closed position for covering the opening of the pipe (200) and an open position where the opening of the pipe (200) is exposed;

a transmission mechanism (22) with one end affixed to the cover plate (1); and a locking device (3) coupled to another end of the transmission mechanism (22), and configured to lock the transmission mechanism (22) to maintain the cover plate (1) at the open position, wherein the at least one set of cover plate assembly forms an extension of the pipe when the cover plate of each of the at least one set of cover plate assembly is in the open position.

2. The cover assembly according to claim 1, comprising at least two sets of cover plate assemblies, wherein the pipe (200) opens upward, and the cover plate (1) of each of the at least two sets of cover plate assemblies is mounted on an edge of the pipe and pivotable about a pivot axis perpendicular to a centerline of the pipe.

3. The cover assembly according to claim 2, comprising two sets of cover plate assemblies, wherein:

the two sets of cover plate assemblies are disposed across the opening of the pipe (200);

at least one cover plate (1) of the two sets of cover plate assembly comprises an intermediate plate (11) and two side plates (12) respectively connected to two opposite ends of the intermediate plate (11);

the intermediate plate (11) is perpendicular to the side plates (12);

when the cover plates (1) of the two sets of cover plate assembly are at the open position, the intermediate plate (11) and the side plates (12) all extend in a vertical direction;

and when the cover plates are at the closed position, the intermediate plate (11) at least partially covers the opening of the pipe (200) and the side plates (12) are located outside the pipe (200).

4. The cover assembly according to claim 2, wherein each of the at least two sets of cover plate assemblies further comprise a connecting member (4) for connecting the cover plate (1) with the pipe (200), and the connecting member (4) comprises:

a base (41) being an integrally fixed on an outside of the pipe (200); and a pivoting portion (42) fixed on the cover plate (1) and pivotally connected with the base (41).

5. The cover assembly according to claim 4, wherein:

the base (41) comprises a base plate (411) and an ear (412);

a portion of the base plate (411) is parallel to a pivot axis of the cover plate (1) and abuts an outer side wall of the pipe (200);

the ear forms a pivot mounting hole (4121); and the pivoting portion (42) includes a plate-shaped structure and is pivotally connected to the pivot mounting hole (4121) of the ear (412).

6. The cover assembly according to claim 1, wherein:

the transmission mechanism (22) comprises a transmission rod:

the transmission rod comprises two first rod portions (2211) and a second rod portion (2212) located between the two first rod portions (2211), both ends of the second rod portion (2212) being sleeved in corresponding first rod portions (2211); and the transmission rod is configured to enable the two first rod portions (2211) to move relative to each other to adjust a total length of the transmission rod.

7. The cover assembly according to claim 1, wherein a bottom end of the transmission mechanism (22) is fixedly connected with a support rod (231), and the cover assembly further comprises a power mechanism (21) comprising:

a hydraulic cylinder (236) pivotable about a first pivot (235) relative to the pipe;

a hydraulic rod (237); and a hydraulic rod ear (232) fixedly disposed at a top end of the hydraulic rod (237) and pivotally connected with the support rod (231) via a second pivot (233) parallel to the first pivot (235), wherein:

the support rod (231) is provided with a through hole;

the locking device (3) includes a pull bolt; and the pull bolt is configured to be inserted into the through hole on the support rod (231) to lock the transmission mechanism (23).

8. The cover assembly according to claim 2, further comprising an additional locking device (73) connected between any two adjacent cover plates, the additional locking device (73) being fixedly mounted on one of the two adjacent cover plates, and being releasably fixed with another of the two adjacent cover plates.

9. The cover assembly according to claim 8, wherein a first cover plate (71) of the two adjacent cover plates is provided with a metal rim, and the additional locking device (73) comprises:

a mounting plate (731) fixedly connected to the first cover plate (71) and protruding toward a second cover plate (72) of the two adjacent cover plates; and a magnet (733) disposed on a portion of the mounting plate (731) protruding from the first cover plate (71), the magnet (733) and the metal rim of the second cover plate (72) facing each other.

10. The cover assembly according to claim 9, wherein the mounting plate (731) is provided with a through hole, and the additional locking device (73) further comprises:

a U-shaped pressing plate (734) with both ends being detachably connected to a surface of the mounting plate (731) facing the second cover plate (72), so that the magnet (733) is cooperatively received in a space jointly defined by the U-shaped pressing plate (734) and the mounting plate (731); and an ejector rod (732) penetrating through the through hole on the mounting plate (731) and configured to be locked relative to the mounting plate (731), and configured to press the magnet (733) in a direction towards the second cover plate (32) so that the magnet (733) can be pressed tightly between the ejector rod (732) and U-shaped pressing plate (734).

11. The cover assembly according to claim 9, wherein an arcuate segment (7311) bent towards the second cover plate (72) is disposed at an edge of the mounting plate (731), and a size of the arcuate segment (7311) in a thickness direction of the mounting plate (731) is smaller than a size of the magnet (733) in the thickness direction of the mounting plate (731).

12. The cover assembly according to claim 1, comprising only one set of cover plate assembly, and the cover plate of the one set of cover plate assembly comprises:

a pipe-shaped structure (851) configured to translate relative to the pipe along an extension direction of the pipe;

the covering plate (852) disposed at one end of the pipe-shaped structure (851) and configured to pivot relative to the pipe-shaped structure to open and close the pipe-shaped structure (851), the cover plate is configured in a way that when the cover plate is at the open position, the pipe-shaped structure (851) forms the extension of the pipe, and when the cover plate is at the closed position, the pipe-shaped structure (851) is sleeved inside or outside the pipe and the covering plate (852) covers the opening of the pipe-shaped structure (851) and the opening of the pipe (200).

13. The cover assembly according to claim 12, wherein one end (852 *a*) of the covering plate is connected to the pipe, and another end (852 *b*) of the covering plate is connected to the pipe-shaped structure (851) via an articulation lever (853).

14. A pipe assembly, wherein the pipe assembly comprises the pipe (200) with the opening and the cover assembly (100) according to claim 1.

15. The pipe assembly according to claim 14, wherein the pipe assembly further comprises a mounting frame (300) fixed on the pipe (200), and the cover assembly (100) comprises a power mechanism (21) mounted on the mounting frame.

16. A turbine fracturing unit, comprising:

a turbine engine; and the cover assembly according to claim 1 mounted at an exhaust port of the turbine engine.

17. The turbine fracturing unit according to claim 16, wherein:

the turbine fracturing unit further comprises a control device (400);

the cover assembly comprises a power mechanism; and a position sensor (500) communicatively connected with the control device (400) and integrated in the power mechanism, wherein the position sensor (500) is configured to sense a position state of the cover plate of the cover assembly, and the control device (400) is configured to disable the turbine engine (600) when the position sensor (500) monitors the cover plate is at the closed position.

* * * * *